United States Patent [19]

Arahara et al.

[11] Patent Number: 4,945,833

[45] Date of Patent: Aug. 7, 1990

[54] PRINTING PROCESS USING A PH CHANGE TO TRANSFER A THIN LAYER OF INK TO A PRINTING PLATE

[75] Inventors: Kohzoh Arahara; Tetsuro Fukui; Hiroshi Fukumoto, all of Kawasaki; Yoshio Takasu, Tama; Tadashi Sato, Kokubunji; Fumitaka Kan, Tokyo, all of Japan

[73] Assignee: Canon Kabushiki Kaisha, Tokyo, Japan

[21] Appl. No.: 287,151

[22] Filed: Dec. 21, 1988

[30] Foreign Application Priority Data

Dec. 24, 1987 [JP] Japan ..... 62-325592

[51] Int. Cl.[5] ..... B41M 1/06

[52] U.S. Cl. ..... 101/450.1; 101/491

[58] Field of Search ..... 101/491, 450.1, 451, 101/465–467; 106/20

[56] References Cited

U.S. PATENT DOCUMENTS 4,080,897 3/1978 Gundlach ..... 101/467
4,336,318 6/1982 Fukumoto et al. .
4,471,694 9/1984 Takasu et al. .
4,533,614 8/1985 Fukumoto et al. .
4,535,048 8/1985 Inoue et al. .
4,559,899 12/1985 Kan et al. .
4,838,940 6/1989 Ken et al. ..... 106/22
4,881,084 11/1989 Kan et al. ..... 346/1.1

*Primary Examiner*—Clifford D. Crowder
*Attorney, Agent, or Firm*—Fitzpatrick, Cella, Harper & Scinto

[57] ABSTRACT

A printing process using an ink which is substantially non-adhesive but can be imparted with an adhesiveness when subjected to a pH change. In the printing process, the ink is subjected to a pH change to be provided with an adhesiveness to a desired depth, and the resultant adhesive ink is supplied to a printing plate having a pattern of ink receptibility to form thereon an ink pattern corresponding to the ink receptibility pattern. The ink pattern is then transferred to a transfer-receiving medium such as plain paper to form thereon a recorded image. In the above-mentioned printing process, a uniform thin ink layer can be supplied to the printing plate by chemically regulating the amount of the ink to be supplied.

7 Claims, 3 Drawing Sheets

PRINTING PROCESS USING A PH CHANGE TO TRANSFER A THIN LAYER OF INK TO A PRINTING PLATE

FIELD OF THE INVENTION AND RELATED ART

The present invention relates to a printing process using various printing plates such as planographic plate.

Hitherto, in printing processes such as planography, ink has been be applied onto a printing plate in a uniform thin-layer form by means of an ink-supply or ink-application device using about six to several tens of inking rollers, as shown in FIG. 3 described hereinafter. These inking rollers generally comprise an ink fountain roller, an ink ductor roller, an ink distributing roller, an intermediate roller, a vibrating roller, a form roller, etc.

However, when such ink-supplying device is used, the device becomes larger because it comprises many inking rollers of six to several tens. Further, maintenance of respective rollers for proper operation is complicated and there is a disadvantage that the operability of the ink-supplying device is not good, and particularly, the regulation of an ink amount supplied to the printing plate surface is extremely troublesome.

On the other hand, our research group has proposed a recording method wherein a pattern of adhesiveness is chemically imparted to ink, and recording is effected by utilizing the difference between the adhesiveness and non-adhesiveness of the ink (Japanese Patent Application No. 175191/1986, corresponding to U.S. patent application Ser. No. 075,045).

This recording method comprises:

- providing a fluid ink which is capable of forming a fluid layer, substantially non-adhesive and capable of being imparted with an adhesiveness on application of an energy,
- forming a layer of the fluid ink on an ink-carrying member,
- applying a pattern of the energy corresponding to a given image signal to the ink layer to form an adhesive pattern of the ink, and
- transferring the adhesive pattern of the ink to a transfer-receiving medium to form thereon an ink pattern corresponding to the energy pattern applied.

Further, our research group has proposed some image recording inks for use in the above-mentioned image recording method (U.S. patent application Ser. No. 156,978, corresponding to Japanese Patent Application Nos. 36904/1987, 15241/1988 and 15242/1988; U.S. patent application Ser. No. 199,452, corresponding to Japanese Patent Application Nos. 31585/1987, 131586/1987 and 139707/1987; and U.S. patent application Ser. No. 241,211, corresponding to Japanese Patent Application Nos. 224145/1987 and 15243/1988).

SUMMARY OF THE INVENTION

A principal object of the present invention is to provide a printing process wherein ink can be supplied to a printing plate in a uniform thin layer by using a compact device excellent in operability.

As a result of our study, we have found that the above-mentioned object is very effectively attained by chemically imparting adhesiveness to ink to a desired depth or thickness thereof, and making an ink layer to be supplied to a printing plate uniform and thinner by utilizing the resultant difference between the adhesiveness and non-adhesiveness of the ink; but not by mechanically making an ink layer uniform and thinner by means of a combination of a large number of rollers in the prior art.

The printing process according to the present invention is based on the above discovery and comprises:

- providing ink which is substantially non-adhesive and capable of being imparted with an adhesiveness when subjected to a pH change;
- imparting a pH change to the ink to provide the ink with an adhesiveness corresponding to the pH change;
- supplying the ink provided with the adhesiveness to a printing plate having a pattern of ink receptibility; and
- transferring the ink from the printing plate to a transfer-receiving medium to form thereon an ink pattern corresponding to the pattern of the ink receptibility.

In the printing process according to the present invention, the amount of ink transfer to the printing plate (or the thickness of the thin ink layer to be supplied to the printing plate) may be regulated by utilizing the control of ink adhesiveness based on a pH change. As a result, in the present invention, the ink may be applied onto the printing plate in a uniform thin layer form by means of an ink-supplying device using about one to two inking rollers, as shown in a schematic sectional side views of FIGS. 1 or 2 appearing hereinafter, and the above-mentioned transfer amount of ink may be regulated very easily.

On the contrary, the ink-supply device used in the conventional printing process comprises a large number of inking rollers and has a complicated structure, as shown in a schematic side sectional view of FIG. 3. Further, the ink supply amount in such device has been controlled by complicatedly regulating various relations among the above-mentioned large number of inking rollers. Incidentally, the ink supply device shown in FIG. 3 comprises an ink fountain roller 31, an ink ductor roller 32, an ink distributing roller 33, an intermediate roller 34, a vibrating roller 35, a form roller 36, a rider roller 37 and a distributing cylinder (or drum) 38. In FIG. 3, ink is supplied from the ink fountain roller 31 to a printing plate surface 39 by using these large number of rollers. Further, in FIG. 3, white circles denote metal rollers and hatched circles denote rubber rollers.

These and other objects, features and advantages of the present invention will become more apparent upon a consideration of the following description of the preferred embodiments of the present invention taken in conjunction with the accompanying drawings, wherein like reference numerals denote like parts. In the following description, "%" and "part(s)" representing a quantitative proportion or ratio are by weight unless otherwise noted specifically.

DESCRIPTION OF THE PREFERRED EMBODIMENTS

Figure 1:
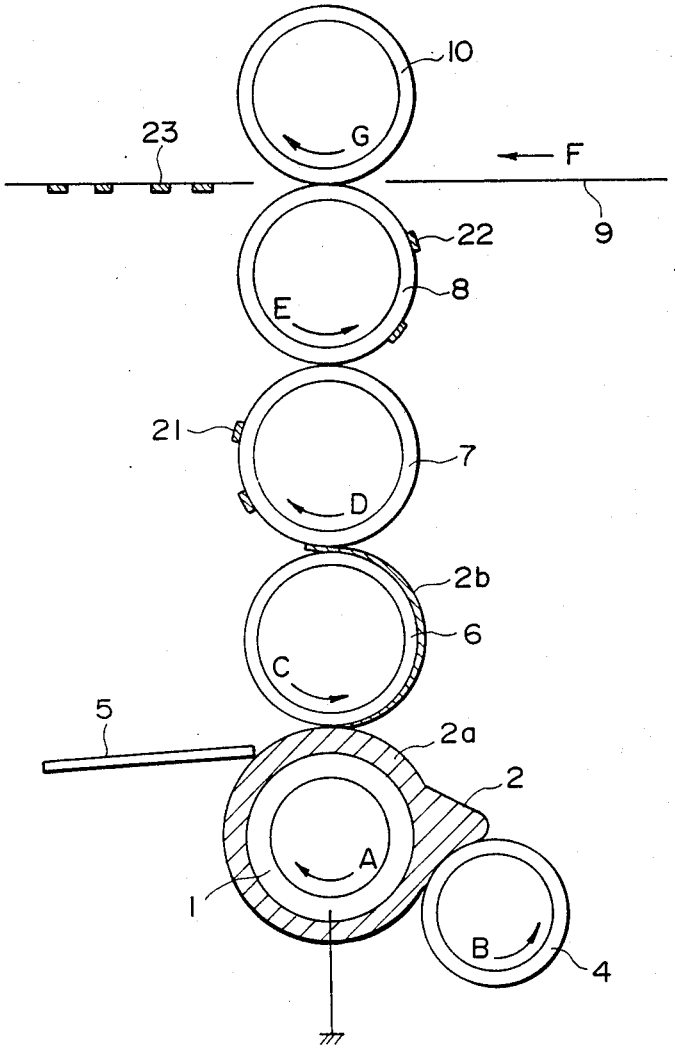
FIG. 1 is a schematic side sectional view of an apparatus for practicing the printing process according to the present invention.

Referring to FIG. 1, a fluid ink 2 is applied onto the surface of an ink-carrying roller 1 by means of an ink layer thickness regulation roller 4 along with the rotation in the arrow A direction of the roller 1 to form thereon an ink layer 2*a* having a predetermined thickness, and is conveyed along with the rotation of the roller 1.

The fluid ink used herein comprises a polyvinyl alcohol, etc., crosslinked with borate ions which is substantially non-adhesive and can be imparted with an adhesiveness on application of a pH change.

The fluid ink moved in this way, after the thickness thereof is regulated by another ink layer thickness-regulation means (not shown) comprising a roller, a blade, etc., as desired, is supplied with a voltage corresponding to the ink depth to be supplied with an adhesiveness from a pH change-imparting electrode 5 at a pH change application position where ink 2 contacts the electrode 5. A current corresponding to the voltage flows, e.g., between the electrode 5 and the ink-carrying roller 1 through ink 2, whereby ink 2 is imparted with an adhesiveness to a desired depth of the ink layer 2*a* based on an electro-chemical reaction in ink 2.

A portion of the ink layer 2*a* selectively imparted with an adhesiveness to the desired depth is further moved in the arrow A direction to reach an ink transfer position where an intermediate roller 6 contacts the ink layer 2*a*, and at least a portion of ink 2 constituting the ink layer 2*a* is transferred onto the intermediate roller 6 rotating in the arrow C direction, on the basis of the above-mentioned adhesiveness to the desired depth, thereby to form a thin ink layer 2*b* thereon.

The remainder of the fluid ink 2 not transferred onto the intermediate roller 6 at the above-mentioned ink transfer position is further moved in the arrow A direction and is separated from the intermediate roller 6 by gravity, etc., because of its non-adhesiveness to be reused.

On the other hand, the thin ink layer 2*b* which has been formed by the transfer of fluid ink 2 at the above-mentioned ink transfer position is then conveyed along with the rotation in the arrow C direction of the intermediate roller 6 to reach the ink supply position where the ink layer 2*b* contacts a plate cylinder 7 rotating in the arrow D direction. At the ink supply position, the thin ink layer 2*b* is transferred onto the plate cylinder 7.

The surface of the plate cylinder 7 has a pattern of ink receptibility, e.g., a pattern of ink receptibility based on hydrophilic-hydrophobic properties. Therefore, the thin ink layer 2*b* is transferred to the plate cylinder 7 corresponding to the ink receptibility pattern of the plate cylinder 7 surface, based on the contact of the thin ink layer having a uniform thickness with the plate cylinder 7 at the above-mentioned ink supply position, whereby an ink pattern 21 is formed on the plate cylinder 7.

Incidentally, a cleaner (not shown) may be disposed, as desired, downstream of the ink supply position along the surface of the intermediate roller 6 in order to remove a residual ink remaining on the intermediate roller 6. When such cleaner is disposed, a thin ink layer 2*b* having a uniform thickness can easily be formed continuously.

While the supply of the ink to the plate cylinder (or a printing plate) is completed in the manner as described hereinabove, the apparatus embodiment shown in FIG. 1 is so constituted that the plate cylinder 7 supplied with ink in the above-mentioned manner can be subjected to a printing process as such.

Referring again to FIG. 1, the ink pattern 21 formed on the plate cylinder 7 on the basis of the ink supply at the above-mentioned ink supply position is conveyed along with the rotation in the arrow D direction of the plate cylinder 7 to reach an ink pattern transfer position where the plate cylinder 7 contacts a blanket cylinder 8 comprising a surface of, e.g., urethane rubber. At the ink pattern transfer position, the ink pattern 21 is transferred onto the blanket cylinder 8 to form an ink pattern 22 thereon.

The above-mentioned ink pattern 22 formed on the blanket cylinder 8 rotating in the arrow E direction is then conveyed to a printing position where the blanket cylinder 8 contacts a recording medium such as plain paper moving in the arrow F direction. At the printing position, the ink pattern 22 is transferred to the recording medium 9 under a pressure exerted by an impression cylinder 10 rotating in the arrow G direction, thereby to form a recorded image 23 on the recording medium 9.

Further, in a case where fixability of the transfer-recorded image 23 to the recording medium 9 is not sufficient, it is possible to dispose a known fixing means (not shown) as by heating or pressing, downstream of the printing position along the recording medium 9 in order to ensure the fixation of the recorded image 23 formed on the recording medium 9.

In the embodiment described hereinabove with reference to FIG. 1, a fluid ink layer having a desired thickness, i.e., at least a portion of the ink layer 2*a* formed on the ink-carrying roller 1, is once transferred to the intermediate roller 6 to form the thin ink layer 2*b*, and thereafter the thin ink layer 2*b* is supplied to the plate cylinder 7. It is also possible that the ink layer 2*a* wherein an adhesiveness is imparted to a desired depth is caused to directly contact the plate cylinder 7 (i.e., with the omission of the intermediate roller 6) thereby to supply the ink to the plate cylinder 7. However, it is preferred to use the intermediate roller 6 comprising a plastic such as polyester or a metal such as aluminum, in order to easily select the material for the fluid ink 2.

It is also possible that the ink pattern 21 formed on the plate cylinder 7 is directly transferred to the recording medium 9 in some cases. However, a printing plate disposed on the plate cylinder can be prevented from wearing by the provision of the blanket cylinder 8.

In the embodiment as shown in FIG. 1, planographic (or offset) printing is conducted. Any of printing plates such as relief and intaglio plate having a pattern of ink receptibility (or ink-receiving property) can be used in the printing process according to the present invention without particular limitation.

In the embodiment as shown in FIG. 1, there is preferably used, e.g., a planographic plate cylinder 7 obtained by electrically attaching toner powder in a pattern to a water-repellent substrate comprising a fluorine-containing polymer, etc., by an electrophotographic process; fixing the toner to the substrate to prepare a printing plate; and winding the resultant printing plate onto a cylindrical substrate of metal, etc. In such case, the surface of the toner image formed on the plate cylinder 7 has a higher surface energy than that of the above-mentioned water-repellent surface on the basis of the material therefor, surface roughness thereof, etc. As a result, the ink 2 on the intermediate roller 6 which has been supplied with a pH change and has a relatively high viscosity may selectively be attached to the toner image.

Next, a somewhat detailed explanation is made on the fluid ink 2 suitably used in the above-mentioned printing process according to the present invention.

The ink used in the present invention may be one which is substantially non-adhesive, and is capable of being imparted with an adhesiveness when subjected to a pH change.

More specifically, an ink satisfying the following property may preferably be used in the present invention.

(1) Layer-Forming Property

The ink used in the present invention may preferably have a layer-forming property such that it can be formed into a layer or film form, e.g., on an ink-carrying member.

More specifically, the ink used in the present invention may preferably be formed into an ink layer having a thickness of about 0.01–100 mm, when it is carried on an ink-carrying roller with a diameter of 200 mm rotating at 5 rpm.

(2) NON-Adhesiveness (or Liquid Dispersion Medium-Retaining Ability)

On the surface of a sample ink held in a container, an aluminum foil of 5 cm×5 cm in size is, after being accurately weighed, placed gently and is left standing as is for 1 min. in an environment of a temperature of 25° C. and a moisture of 60%. Then, the aluminum foil is gently peeled off from the surface of the ink and then quickly weighed accurately to measure the increase in weight of the aluminum foil. Through the measurement, the ink used in the present invention should preferably show substantially no transfer of its solid content and a weight increase of the aluminum foil of about 0–1000 mg, particularly on the order of 0–100 mg. In the above measurement, it is possible to separate the aluminum foil from the fluid ink body, if necessary, with the aid of a spatula.

If the non-adhesiveness of the ink used in the present invention is insufficient in light of the above standard, the ink per se can transfer to an intermediate roller 6, etc., to a practically non-negligible extent even under no pH change, whereby it becomes difficult to form a thin ink layer **2*b*** having a uniform thickness utilizing the difference between adhesiveness and non-adhesiveness of the ink, and the image quality is lowered.

The ink having the above-mentioned layer-forming property and non-adhesiveness may preferably be an ink in the form of a gel, in a broad sense, comprising a crosslinked substance impregnated with a liquid dispersion medium, or an ink in the form of a sludge obtained by dispersing particles having a particle size of preferably 0.1–100 microns, further preferably 1–20 microns, in a dispersion medium having a relatively high viscosity (preferably, a viscosity of 5,000 centipoises (cps) or more).

An ink having both properties of the gel ink and sludge ink may more preferably be used. With respect to the former gel ink of these inks, it is presumed that the gel ink is not substantially transferred to an intermediate roller 6 because the liquid dispersion medium except for a minor portion thereof is well retained in the crosslinked structure.

With respect to the latter sludge ink, it is presumed that the ink is not substantially transferred to an intermediate roller 6 because the particles are tightly aligned on the ink interface so that the contact of the dispersion medium with the intermediate roller 6 is suppressed. Particularly in this sludge ink, when a rotating ink-carrying member is used, the particles in the ink are aligned on the outer surface of the ink layer under the action of a centrifugal force, whereby the ink desirably behaves like a dilatant fluid.

It is also presumed that when the pH of the gel ink or sludge ink is changed on the basis of electric conduction, etc., the crosslinked structure, ionic structure or the alignment state of the particles is changed thereby, so that the fluid ink is imparted with a selective adhesiveness to a desired depth corresponding to the pH change.

As described above, the ink used in the present invention may preferably comprise a crosslinked substance (inclusive of polyelectrolyte) impregnated with a liquid dispersion medium.

Herein, the "crosslinked substance" refers to a single substance which per se can assume a crosslinked structure, or a mixture of a substance capable of assuming a crosslinked structure with the aid of an additive such as a crosslinking agent for providing an inorganic ion such as borate ion, and the additive. Further, the term "crosslinked structure" refers to a three-dimensional structure having a crosslinkage or crosslinking bond. The crosslinkage may be composed of any one or more of covalent bond, ionic bond, hydrogen bond and van der Waal's bond.

In the ink used in the present invention, the crosslinked structure is only required to be such that a desired degree of liquid dispersion medium-retaining property is given thereby. More specifically, the crosslinked structure may be any one of a network, a honeycomb, a helix, etc., or may be an irregular one.

The liquid dispersion medium in the ink 2 used in the present invention may be any inorganic or organic liquid medium which is preferably liquid at room temperature. The liquid medium should preferably have a relatively low volatility, e.g., one equal to or even lower than that of water.

In case where a hydrophilic dispersion medium such as water and an aqueous medium is used as the liquid dispersion medium, the crosslinked substance may preferably be composed of or from a natural or synthetic hydrophilic high polymer or macromolecular substance.

Examples of such a hydrophilic high polymer include: plant polymers, such as guar gum, locust bean gum, gum arabic, tragacanth, carrageenah, pectin, mannan, and starch; microorganism polymers, such as xanthane gum, dextrin, succinoglucan, and curdran; animal polymers, such as gelatin, casein, albumin, and collagen; cellulose polymers such as methyl cellulose, ethyl cellulose, and hydroxyethyl cellulose; starch polymers, such as soluble starch, carboxymethyl starch, and methyl starch; alginic acid polymers, such as propylene glycol alginate, and alginic acid salts; other semisynthetic polymers, such as derivatives of polysaccharides; vinyl polymers, such as polyvinyl alcohol, polyvinylpyrolidone, polyvinyl methyl ether, carboxyvinyl polymer, and sodium polyacrylate; and other synthetic polymers, such as polyethylene glycol, and ethylene oxide-propylene oxide block copolymer. These polymers may be used singly or in mixture of two or more species, as desired.

The hydrophilic polymer may preferably be used in a proportion of 0.2–50 parts, particularly 0.5–30 parts, with respect to 100 parts of the liquid dispersion medium.

In the ink used in the present invention, a polyelectrolyte may further preferably be used as the above-mentioned crosslinked substance. The "polyelectrolyte" used herein refers to a polymer or macromolecular substance having a dissociative group in the polymer chain (i.e., main chain or side chain) thereof.

In a case where such polyelectrolyte is used, there is not necessarily required the addition of another electrolyte for providing an electroconductivity to the ink, or the addition of an ionic crosslinking agent (such as borate ion) for facilitating the adhesiveness control. As a result, the stability or storability of the ink may desirably be improved because of the simplification of the ink system.

Examples of the polyelectrolyte capable of providing a poly ion when dissociated in water may include, e.g., natural polymers such as alginic acid and gelatin; and synthetic polymers obtained by introducing a dissociative group into ordinary polymers, such as polystyrenesulfonic acid and polyacrylic acid. Among these polyelectrolytes, an amphoteric polyelectrolyte capable of being dissociated as either an acid or a base, such as a protein may preferably be used, in order to obtain a desired change in the ink adhesiveness based on a pH change. The reason for this is that the pH value of such ink may easily be changed reversibly and the ink may easily be reused.

There may particularly preferably be used an amphoteric polyelectrolyte having an isoelectric point of 4–10, more preferably 4.5"9. Such amphoteric polyelectrolyte may preferably be a peptide or a protein, particularly gelatin.

On the other hand, when oil such as mineral oil or an organic solvent such as toluene is used as the liquid dispersion medium, the crosslinked substance may be composed of or from one or a mixture of two or more compounds selected from metallic soaps inclusive or metal stearates, such as aluminum stearate, magnesium stearate, and zinc stearate, and, similar metal salts of other fatty acids, such as palmitic acid, myristic acid, and lauric acid; or organic substances such as hydroxypropyl cellulose derivative, dibenzylidene-D-sorbitol, sucrose fatty acid esters, and dextrin fatty acid esters. These crosslinked substances may be used in the same manner as the above-mentioned hydrophilic polymers.

When the hydrophilic polymer, polyelectrolyte or metallic soap, etc., is used, the layer-forming property and liquid dispersion medium-retaining ability of the resultant ink vary to some extent depending on the formulation of these components or combination thereof with a liquid dispersion medium. It is somewhat difficult to determine the formulation or composition of these components in a single way. Accordingly, it is preferred to formulate a composition of a liquid dispersion medium and a crosslinked substance (such as polyelectrolyte) so that the resultant ink will satisfy the layer-forming property and non-adhesiveness (liquid dispersion medium-retaining property) as described above.

The ink used in the present invention may preferably comprise a liquid dispersion medium and a crosslinked substance (inclusive of polyelectrolyte), as described above, and may further comprise, as desired, a colorant inclusive of dye, pigment and colored fine particles, a color-forming compound capable of generating a color under a pH change, an electrolyte providing electroconductivity to the ink, or another additive such as an antifungal agent or an antiseptic.

The colorant or coloring agent may be any of dyes and pigments generally used in the field of printing and recording, such as carbon black. Among these, a dye or pigment, particularly a pigment, having a relatively low affinity to the liquid dispersion medium is preferably used in order to suppress the coloring of the intermediate roller 6, due to the transfer thereto of the liquid dispersion medium under no pH change. The pigment or dye may preferably be used in a proportion of 0.1 part or more, more preferably 5–50 parts, particularly 10–30 parts, per 100 parts of the liquid dispersion medium.

Further, the colorant may be in the form of fine colored particles, like a toner of various colors for electrophotography, obtained by dispersing a pigment or dye as described above in a natural or synthetic resin and forming the dispersion into fine particles. An ink containing such colored particles behaves like a dilatant liquid and is particularly preferred in respect of suppressing the transfer of the liquid dispersion medium to or coloring of the intermediate roller 6 under no pH change.

The colored fine particles may preferably be used in a proportion of 1 part or more, further preferably 5–100 parts, particularly preferably 20–80 parts, per 100 parts of the liquid dispersion medium. Generally speaking, it is preferred that colored particles having a large size are incorporated in a higher proportion in order to provide a better coloring characteristic. Incidentally, the above-mentioned toner particles can be used regardless of the electrophotographic characteristic such as charging characteristic thereof.

The colorant inclusive of the pigment or the colored fine particles may preferably have a particle size of 0.1–100 microns, particularly 1–20 microns.

If the particle size is below 0.1 micron, the colorant particles are not retained in the crosslinked structure but are transferred together with the liquid dispersion medium even when the ink contacts the intermediate roller 6 under no pH change, whereby an image fog is liable to result. On the other hand, if the particle size exceeds 100 microns, a resolution required for an ordinary image is not satisfied.

The ink used in the printing process of the present invention may be obtained from the above components, for example, by uniformly mixing a liquid dispersion medium such as water, a crosslinked substance such as a polyelectrolyte, and also an optional additive such as a crosslinking agent, a colorant, an electrolyte, etc., under heating as desired, to form a viscous solution or dispersion, which is then cooled to be formed into a gel state.

Incidentally, when colored particles such as toner particles are used as a colorant, it is preferred that a crosslinked substance and a liquid dispersion medium are first mixed under heating to form a uniform liquid, and then the colored particles are added thereto. In this case, it is further preferred that the addition of the particles is effected in the neighborhood of room temperature so as to avoid the agglomeration of the particles.

The thus obtained ink, when subjected to a pH change, is at least partially subjected to a change in or destruction of the crosslinked structure to be reversibly converted from a gel state into a sol state, whereby it is selectively imparted with an adhesiveness corresponding to the pH change. Alternatively, the dissociation state of the polyelectrolyte contained in the ink may change, whereby the ink is selectively imparted with an adhesiveness corresponding to the pH change.

Hereinabove, there has been described the ink used in the present invention. Now, there will be described a method of imparting a desired pH change to the ink.

(1) Electric Conduction

The pH value of the ink in the neighborhood of an electrode may be changed by an electrochemical reaction. More specifically, the crosslinked structure or dissociative state of an electrolyte may be changed by electron transfer due to the electrode, thereby to change the ink adhesiveness.

(2) Addition of pH-Modifier

The "pH-modifier" used herein refers to a substance capable of causing a desired pH change on (or in) the ink.

Preferred examples of such pH modifier include an electron acceptor (or electron pair-acceptor) and an electron donor (or electron pair-donor).

Specific examples of the electron acceptor include: Lewis acids including inorganic acids such as hydrochloric acid, nitric acid; organic acids such as acetic acid; etc. The pH value of the ink may be changed to the acidic side by adding or imparting such electron acceptor thereto, whereby the ink is imparted with a desired adhesiveness.

On the other hand, specific examples of the electron donor include: Lewis base including inorganic bases such as sodium hydroxide, potassium hydroxide, ammonia, ammonium hydroxide; organic bases such as amines; etc. The pH value of the ink may be changed to the basic side by adding or imparting such electron donor thereto, whereby the ink is imparted with a desired adhesiveness.

In the present invention, means for imparting such electron acceptor or electron donor to the ink is not particularly restricted, but it is preferred that the electron acceptor or electron donor is imparted to the entire surface of an ink, e.g., by means of a roller for a rotary press, in view of uniform addition of the electron acceptor, etc., to the ink.

According to our knowledge, e.g., when a polyvinyl alcohol crosslinked with borate ions is used as the crosslinked substance, the change in the crosslinked structure caused by a pH change may be considered as follows.

Thus, when the borate ion bonded to the —OH groups of the polyvinyl alcohol,

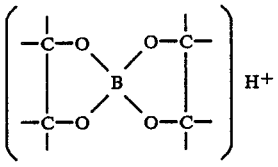

is subjected to an anodic reaction in the neighborhood of an anode (or the addition of an electron acceptor such as hydrochloric acid), the pH of the ink is changed to the acidic side and electrons may be removed from the above-mentioned borate ion to destroy at least a part of the crosslinked structure, whereby the ink may be imparted with an adhesiveness selectively. The reaction at this time may presumably be expressed by the following formula:

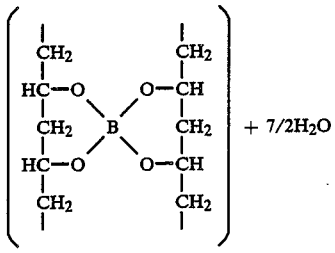

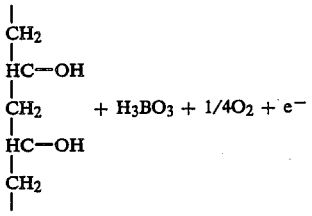

Further, there is explained an embodiment wherein a change in the dissociation condition of a polyelectrolyte based on a pH change is utilized.

Thus, in a case where a peptide compound comprising at least one amino acid is used as the polyelectrolyte, when the pH of the ink is changed to the basic side due to the cathodic reaction in the neighborhood of a cathode based on electric conduction (or the addition of an electron donor), an $—NH_3^+$ group of the amino acid is changed to an $—NH_2$ group. On the other hand, when the pH of the ink is changed to the acidic side due to the anodic reaction in the neighborhood of an anode based on electric conduction (or the addition of an electron acceptor), a —COO— group of the amino acid is changed to a —COOH group. Because of such change in the dissociation condition of the amino acid, there may be caused a change in the crosslinked structure whereby a difference in the ink adhesiveness is provided.

According to our knowledge, the reaction at this time may presumably be expressed by the following formula:

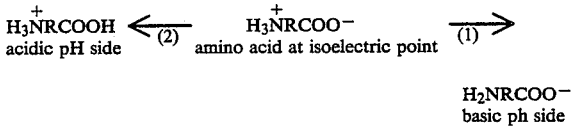

(1): cathodic reaction based on electric conduction, or addition of electron donor
(2): anodic reaction based on electric conduction, or addition of electron acceptor Hereinabove, there has been described a method of imparting a pH change to the ink used in the present invention, in somewhat detail. Next, the respective parts shown in the figures will be explained specifically.

Referring to FIG. 1, the ink-carrying roller 1 is a member having a cylindrical shape and rotating in the arrow A direction.

The cylindrical ink-carrying surface of the roller 1 for carrying the ink may be composed of any material, as far as it is possible to form a desired layer of the fluid ink 2 when it is rotated in the arrow A direction. More specifically, the roller surface may be composed of a conductive material such as metal including stainless steel or an insulating material such as various resins.

The surface composed of such a material of the ink-carrying roller 1 can be smooth but may preferably be a roughened one to an appropriate extent (e.g., a roughness of the order of 1S) so as to enhance the conveying and carrying characteristics thereof with respect to the ink 2.

The thickness of the layer 2*a* of the fluid ink formed on the ink-carrying roller 1 can vary depending on various factors including the fluidity or viscosity of the fluid ink 2, the surface material and roughness thereof of the ink-carrying roller 1, and the rotational speed of the roller 1, but may preferably be generally about 0.01–100 mm, further preferably about 0.1–10 mm, as measured at the ink transfer position where the roller 1 confronts the intermediate roller 6.

If the layer thickness of the ink 2 is below 0.01 mm, it is difficult to form a uniform ink layer on the ink-carrying roller 1. On the other hand, if he ink layer thickness exceeds 100 mm, it becomes difficult to convey the ink 2 while keeping a uniform peripheral speed of the surface portion on the side contacting the intermediate roller 6. Further, in such case, it is not easy to pass an electric current from the pH change-imparting electrode 5 to the ink-carrying roller 1.

On the other hand, the ink transfer means for transferring the ink 2 from the ink-carrying roller 1 to the plate cylinder 7, can be composed of a metal or plastic film moving in one direction or can be constituted in the form of an endless belt, but may preferably be in the form of an intermediate roller 6 as shown in FIG. 1 in order to accurately control the ink transfer conditions by adjusting the conveying speed at the ink transfer position and to facilitate pressure application at the interface with the plate cylinder 7.

The peripheral surface of the intermediate roller 6 may be composed of a similar material as that constituting the surface of the ink-carrying roller 1 but may preferably be provided with an improved smoothness, anti-staining characteristic, or cleaning facility, e.g., by plating of chromium, etc. In order to improve the uniformity in the thickness of transferred ink 2 at the ink transfer position, it is preferred that the surface of the intermediate roller 6 has a higher smoothness than that of the ink-carrying roller 1.

It is preferred that a certain shear stress is applied to the layer of the ink 2 sandwiched between the intermediate roller 6 and the ink-carrying roller 1 at the ink transfer position. For this reason, it is preferred that the peripheral speed of the intermediate roller 6 is made equal to or smaller than, particularly about 50–95% of, the superficial peripheral speed of the ink layer on the ink-carrying roller 1.

On the other hand, if the peripheral speed of the intermediate roller 6 is larger than the superficial peripheral speed of the ink layer 2*a* on the ink-carrying roller 1, an undesirable phenomenon of the whole ink layer 2*a* being transferred to the intermediate roller 6 under no pH change is liable to occur.

Further, when the surfaces of the intermediate roller 6 and the ink-carrying roller 1 are composed of similar materials and have almost the same smoothness, it is preferred to apply a certain shear stress as described above to the ink layer 2*a* at the ink transfer position. The utilization of such a shear stress closely relates to rheological characteristics of the ink, such as thixotropy, pseudoplasticity, and dilatancy, and is preferred in order to improve the uniformity in transfer thickness of the ink 2.

In the present invention, in order to impart a desired pH change in the thickness direction to the ink layer 2*a* formed on the ink-carrying roller 1, there may be used a pH change-imparting electrode 5, or a means for supplying an electron acceptor or electron donor.

The above-mentioned electrode 5 may preferably be one obtained by plating a substrate of a metal such as copper with another metal such as gold and platinum. The electrode 5 may be in the form of either a plate or a roller. It is preferred to dispose the electrode 5 so that it may impart an adhesiveness to the ink 2 to a uniform depth (or thickness) along the extension direction intersecting (particularly, being perpendicular to) the moving direction of the ink 2.

In the embodiment described above with reference to FIG. 1, a current is passed between the electrode 5 and the ink-carrying roller 1. It is also possible to dispose a plurality of electrode elements on the electrode 5 and to pass a current between these plural electrode elements.

In an embodiment wherein the ink 2 is supplied with an adhesiveness by electric conduction, the amount of change in pH value (i.e., the thickness of the thin ink layer 2*b* formed on the intermediate roller 6) may be controlled by regulating the voltage or current with respect to the electric conduction.

Figure 4:
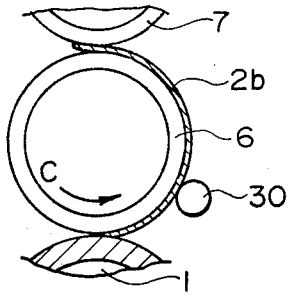
FIGS. 4 and 5 are respectively a schematic side sectional view of another apparatus for practicing the printing process according to the present invention.

Further, in such embodiment, when the width of the conductive part of the electrode 5 (i.e., the width thereof in the direction parallel to that of the generatrix (or generating line) of the ink-carrying roller 1) is decreased, and a vibrating roller 30 is disposed adjacently to the intermediate roller 6 as shown in a schematic partial sectional view of FIG. 4, the ink layer 2*b* formed on the intermediate roller 6 may easily be thinner. Referring to FIG. 4, such vibrating roller 30 may be disposed so that it contacts the ink layer 2*b* at a position downstream of the ink transfer position where the ink 2 is transferred from the ink-carrying roller 1 to the intermediate roller 6, and upstream of the ink supply position where the ink layer 2*b* contacts the plate cylinder 7. The vibrating roller 30 may preferably vibrate in the direction parallel to that of the generatrix of the intermediate roller 6.

On the other hand, another means for changing the ink pH without using electric conduction may preferably be one for discharging or applying a pH-modifier liquid such as a solution. More specifically, the above-mentioned liquid application means may preferably be an applicator 55 as shown in a schematic side sectional view of FIG. 2.

Figure 2:
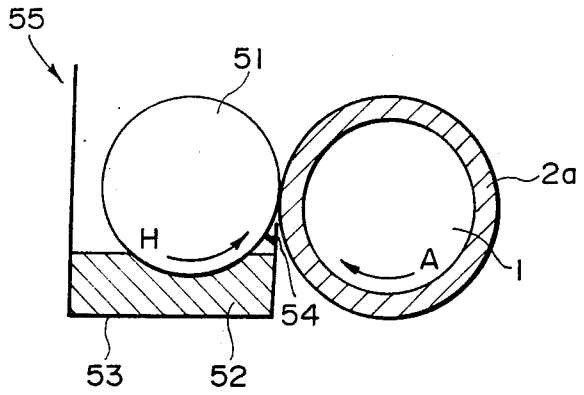
FIG. 2 is a partial schematic side sectional view showing another embodiment of a pH change application means usable in the above-mentioned apparatus.
Figure 3:
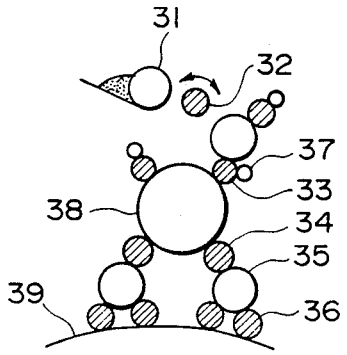
FIG. 3 is a schematic side sectional view showing a conventional ink-supply mechanism using mechanical means.

Referring to FIG. 2, a liquid-applying roller 51 having a surface of stainless steel, etc., within liquid container 53 for holding therein a liquid comprising an electron acceptor or electron donor (such as a solution thereof) 52 so that it rotates in the direction of an arrow H while carrying the liquid 52.

At a pH change-imparting position, the liquid 52 is applied from the liquid-applying roller 51 to an ink layer 2a formed on the ink-carrying roller 1 which contacts the roller 51, whereby the ink layer 2a is supplied with an adhesiveness to a desired depth thereof. The amount of the liquid 52 supplied from the liquid-applying roller 51 may be regulated, as desired, by an application amount regulation means 54 comprising a blade or felt, which may optionally be disposed along the surface of the liquid-applying roller 51 upstream of the above-mentioned pH change-imparting position (i.e., liquid application position).

Instead of such coating method using a roller, there may be used a means for discharging the liquid 52 while controlling the discharge amount thereof (not shown), such as a printing head for a bubble jet-type ink jet printer.

In order to control the amount of change in pH value of the ink 2, the application amount regulation member 54 or the rotating speed of the liquid-applying roller 51 may be regulated in the case of the above-mentioned roller coating method, or the heating time or heating temperature, etc., with respect to the printing head may be regulated in the case of the printing head for the ink jet printer. By using such manner, the application amount of the liquid 52 comprising an electron acceptor or electron donor can be controlled to regulate the amount of change in pH value of the ink 2.

Figure 5:
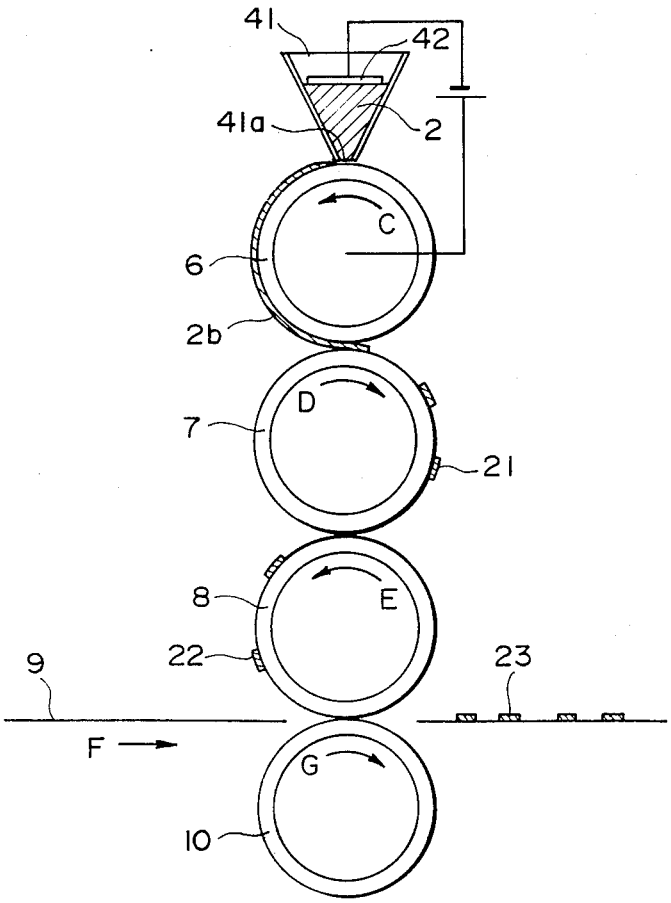

Further, in order to supply the ink 2 to the intermediate roller 6, there may be used an ink-holding member (or ink fountain) 41 having an ink discharge port 41a as shown in FIG. 5, instead of using the ink-carrying roller 1 as shown in FIG. 1.

In FIG. 5, the ink-holding member 41 has a discharge port 41a, e.g., in the form of a slit extending in a direction perpendicular to the moving direction of the ink layer 2b, and the ink 2 contained in the ink-holding member 41 is supplied to the intermediate roller 6 to form thereon the thin ink layer 2b. In such embodiment, an electrode 42 in the form of a lid may for example be disposed on the ink 2 held in the ink-holding member, and a voltage may be applied between the electrode 42 and the intermediate roller 6.

Hereinbelow, the present invention will be explained with reference to Examples.

EXAMPLE 1

| Example 1 | |
|---|---|
| <Prescription A> | |
| Propylene glycol | 50 wt. parts |
| Water | 50 wt. parts |
| Polyvinyl alcohol (Gohsenol KP-08, mfd. by Nihon Gosei Kagaku Kogyo K.K.) | 24 wt. parts |
| Potassium chloride | 14 wt. parts |
| Carbon black (Stering SR, mfd. by Cabot Co., U.S.A.) | 10 wt. parts |
| <Prescription B> | |
| 1N-aqueous NaOH solution | 3.3 wt. parts |
| 20 wt. %-propylene glycol solution of sodium borate | 3.3 wt. parts |

The above ingredients of Prescription A were uniformly mixed under heating at 80°–90° C. and thereafter the above ingredients of Prescription B were added thereto under stirring, thereby to obtain an ink in the form of a gel (pH=8.0 as measured by pH-test paper) to be used in the present invention. In the thus obtained gel ink, it was assumed that —OH groups of the polyvinyl alcohol were crosslinked by the borate ions.

A portion of the ink obtained above was used as a sample and on the surface of the sample ink, an aluminum foil of 5 cm×5 cm in size was placed gently and was left standing as it was for 1 min. in an environment of a temperature of 25° C. and a moisture of 60%. Then, the aluminum foil was gently peeled off from the surface of the ink and then quickly weighed accurately to measure the increase in weight of the aluminum foil. As a result, the increase in weight of the aluminum foil was substantially none (i.e., below 0.1 g).

Then, a portion of the ink was used as a sample and 1N—HCl was added thereto to change the pH value to 3. By using the thus obtained ink, an adhesion test was conducted by using an aluminum foil in the same manner as described above. As a result, it was found that 1.0 g of the ink adhered to the aluminum foil.

The ink obtained above was used in an apparatus as shown in FIG. 1, and supply of the ink to a printing plate, and printing were conducted by using the apparatus.

More specifically, referring to FIG. 1, an ink layer thickness regulation roller 4 of stainless steel surface with a teflon layer was one which was disposed upstream of a pH change-imparting means 5 with respect to the rotating direction of an ink-carrying roller 1, and was used for applying the above-mentioned ink 2 onto the surface of the ink-carrying roller 1 to form an ink layer having a predetermined thickness. in this instance, as shown in FIG. 1, the ink layer thickness regulation roller 4 having an outside diameter of about 100 mm was rotatably disposed and was rotated in the arrow B direction, thereby to apply the ink 2 onto the surface of the ink-carrying roller 1.

The ink-carrying roller 1 was rotated in the arrow A direction at about 5 rpm to form thereon a layer 2a of the fluid ink 2, and in contact with the ink layer 2a, an intermediate roller 6 was rotated in the arrow C direction at about 5 rpm.

In this instance, when an electric energy was not supplied from a pH change-imparting electrode 5 to the ink layer 2a, a very slight amount of water was transferred to the intermediate roller 6, but the ink 2 was not substantially transferred to the intermediate roller 6. The pH change-imparting electrode 5 comprised a copper plate plated with gold which had a thickness of 1 mm and a width (i.e., the length thereof in the direction parallel to the rotation axis of the intermediate roller 6) equal to the length of the rotation axis of the intermediate roller 6. The electrode 5 was disposed so that it contacted the ink layer 2a along an extension direction perpendicular to the moving direction of the ink 2.

When a voltage of 20 V was applied through the ink layer 2a between the pH change-imparting electrode 5 as the anode, and the ink-carrying roller 1 as the cathode, the ink 2 was transferred onto the intermediate roller 6 to form thereon a thin ink layer 2b having a thickness of about 5 microns. The transferred ink 2 had a pH value of 3.

In this instance, there was used a plate cylinder 7 obtained by winding a printing plate to a cylindrical roller of stainless steel having a diameter of 200 mm. The printing plate was prepared in the following manner.

A fluorine-containing polymer paint for forming a water-repellent coating film (trade name: FC-721, mfd. by Sumitomo Three-Emu K.K.) was applied onto a 100 micron-thick polyimide film to form an about 1 micron-thick water-repellent coating on the polyimide film. On the thus treated polyimide film, a pattern of electrophotographic toner particles (average particle size: 9 microns) was formed and fixed thereto by means of an ordinary electrophotographic dry copying machine (trade name: PC-10, mfd. by Canon K.K.). The toner particles used herein were those obtained by uniformly dispersing an inorganic pigment in a binder resin predominantly comprising a polyamide resin.

When the plate cylinder 7 obtained above was rotated in the arrow D direction at about 5 rpm in contact with the thin ink layer 2b formed on the intermediate roller 6, the thin ink layer 2b was selectively (or patternwise) transferred onto the toner image on the above-mentioned plate cylinder 7, thereby to form an ink pattern 21.

Then, a blanket cylinder 8 having a surface of urethane rubber was rotated in the arrow E direction at about 5 rpm in contact with the above-mentioned plate cylinder 7 at an ink image transfer position, and at a printing position, an impression cylinder 10 surfaced with a silicone rubber layer was disposed opposite to the blanket cylinder 8 with a recording medium 9 of plain paper disposed therebetween moving in the arrow F direction. Further, the impression cylinder 10 was rotated in the arrow G direction at the same speed as the blanket cylinder while exerting a slight pressure onto the recording medium 9. As a result, a recorded image 23, as a faithful reproduction of the toner image disposed on the plate cylinder 7, was formed on the recording medium 9.

When the above-mentioned printing process was repeated, 100 sheets of printed matter having recorded images 23 were obtained. The thus obtained recorded images 23 were good so that they were sufficiently usable in practice.

COMPARATIVE EXAMPLE 1

Printing operation was conducted in the same manner as in Example 1 except that a current was not applied between the pH change-imparting electrode 5 and the ink-carrying roller 1. As a result, the ink 2 was not substantially attached to the intermediate roller 6, and therefore a recorded image 23 was not formed on the recording medium 9.

EXAMPLE 2

| Example 2 | |
|---|---|
| Water | 100 wt. parts |
| Gelatin (trade name: S2088, mfd. by Nippi Gelatin Kogyo K.K.) | 14 wt. parts |
| Blue dye (trade name: Water Blue B105, mfd. by Orient Kagaku K.K.) | 3 wt. parts |
| Potassium chloride | 3 wt. parts |

The above ingredients were mixed under heating at 70° C., and 4 wt. parts of triethanolamine was added thereto, and the resultant mixture was cooled at room temperature to obtain a gel ink (pH value=6.5 as measured by litmus paper) to be used in the present invention.

A portion of the thus obtained ink was used as a sample and was subjected to the adhesion test using an aluminum foil in the same manner as in Example 1. As a result, the amount of adhesion of the ink was substantially none (i.e., below 0.1 g).

Then, a portion of the ink was used as a sample and 1N-sodium hydroxide solution was added thereto to change the pH value to 9.5. By using the thus obtained ink, an adhesion test was conducted by using an aluminum foil in the same manner as described above. As a result, it was found that 1.3 g of the ink adhered to the aluminum foil.

Separately, a portion of the ink was used as a sample and 1N—HCl was added thereto to change the pH value to 4.0. By using the thus obtained ink, an adhesion test was conducted by using an aluminum foil in the same manner as described above. As a result, it was found that 0.5 g of the ink adhered to the aluminum foil.

The ink was converted into a sol state under heating at 70° C., and then formed into an ink roll which comprised a stainless steel roller (i.e., a core) having a diameter of 100 mm and a surface roughness of 1S, and a layer of the ink disposed thereon, by means of a mold. The resultant product was then cooled to obtain an ink roll having an ink layer which had a thickness of 2 mm and was solid at room temperature (25° C.).

Printing was conducted in the same manner as in Example 1 except that the above-obtained ink roll having a solid ink layer 2a was used instead of the fluid ink 2 and the ink-carrying roller 1 coated with a layer of the fluid ink used in Example 1. As a result, recorded images 23 corresponding to the toner image formed on the printing plate were similarly obtained as in Example 1.

COMPARATIVE EXAMPLE 2

Printing operation was conducted in the same manner as in Example 2 except that a current was not applied between the pH change-imparting electrode 5 and the ink roll. As a result, the ink was not substantially attached to the intermediate roller 6, and therefore a recorded image 23 was not formed on the recording medium 9.

EXAMPLE 3

Printing was conducted in the same manner as in Example 2 except that a liquid application device 55 as shown in FIG. 2 was used as a means for imparting a pH change to the ink, instead of the pH change-imparting electrode 5 used in Example 2. As a result, recorded images 23 corresponding to the toner image formed on the printing plate were similarly obtained as in Example 2.

In the liquid application device 55 used in this instance, as shown in FIG. 2, a liquid-applying roller 51 of stainless steel was rotated in the arrow H direction at 5 rpm in contact with a 0.1N-aqueous hydrochloric acid solution 52, and the application amount of the above-mentioned liquid was regulated by means of a urethane rubber blade 54. When the above-mentioned liquid-applying roller 51 was disposed at a pH change-imparting position in contact with the above-mentioned solid ink layer 2a, the pH value of the ink surface was changed to 4 and a portion of the ink layer 2a was transferred onto the intermediate roller 6, to form an about 6 micron-thick thin ink layer 2b on the roller 6.

COMPARATIVE EXAMPLE 3

Printing operation was conducted in the same manner as in Example 3 except that the hydrochloric acid solution was not applied onto the ink layer 2a. As a result, the ink 2 was not substantially attached to the intermediate roller 6, and therefore a recorded image 23 was not formed on the recording medium.

EXAMPLE 4

Printing was conducted in the same manner as in Example 3 except that a 0.1N-aqueous sodium hydroxide solution was used as a liquid 52 instead of the 0.1N-hydrochloric acid used in Example 3, to change the pH value on the surface of the ink layer *2a* of the ink roll to 11. As a result, recorded images 23 corresponding to the toner image formed on the printing plate were similarly obtained as in Example 3.

As described hereinabove, according to the present invention, there is provided a printing process wherein an ink in a uniform thin layer form is supplied to a printing plate by means of a device using about one or two inking rollers, and further the supply amount of the ink can easily be controlled by regulating the voltage or current applied to a pH change-imparting electrode, or the application amount of an electron acceptor solution, etc. As a result, according to the present invention, the device for applying a printing ink can be made compact and the operability in the regulation of ink application amount can be improved.

Further, because the printing process of the present invention uses a substantially non-adhesive ink, the ink can very easily be handled at the time of replenishing a printing device therewith.

What is claimed is:

1. A printing process comprising:

providing an ink which is substantially non-adhesive and capable of being imparted with an adhesiveness when subjected to a pH change;

imparting a pH change to the ink to provide the ink with an adhesiveness corresponding to the pH change;

supplying the ink provided with the adhesiveness to a printing plate having a pattern of ink receptibility; and transferring the ink from the printing plate to a transfer-receiving medium to form thereon an ink pattern corresponding to the pattern of the ink receptibility.

2. A process according to claim 1, wherein said ink provided with an adhesiveness corresponding to the pH change is once transferred to an intermediate roller, and then is supplied to the printing plate.

3. A process according to claim 2, wherein said ink is applied onto the surface of an ink-carrying roller and then is imparted with a pH change.

4. A process according to claim 3, wherein a liquid comprising an electron acceptor or electron donor is carried on the surface of a liquid-applying roller, and the liquid carried on the liquid-applying roller surface is caused to contact said ink to impart a pH change to thereto.

5. A process according to claim 1, wherein said ink is provided with an adhesiveness by a pH change based on electric conduction.

6. A process according to claim 1, wherein said ink is provided with an adhesiveness by a pH change based on the addition of an electron acceptor.

7. A process according to claim 1, wherein the ink is provided with an adhesiveness by a pH change based on the addition of an electron donor.

* * * * *

UNITED STATES PATENT AND TRADEMARK OFFICE

CERTIFICATE OF CORRECTION

PATENT NO. : 4,945,833

DATED : August 7, 1990

INVENTOR(S) : Kohzoh Arahara, et al.

It is certified that error appears in the above-identified patent and that said Letters Patent is hereby corrected as shown below:

On the title page: Item

[56] REFERENCES CITED:

Change "4,838,940 6/1989 Ken et al." to -- 4,838,940 6/1989 Kan et al. --.

COLUMN 1:

Line 9, change "plate." to -- plates. --.

Line 52, change "Nos. 31585/1987," to -- Nos. 131585/1987, --.

Line 68, change "ink; but not" to -- ink; instead of --.

COLUMN 2

Line 2, change "in" to -- as in --.

Line 26, delete "form".

Line 29, change "views" to -- view --.

Line 45, change "these" to -- this --.

UNITED STATES PATENT AND TRADEMARK OFFICE

CERTIFICATE OF CORRECTION

PATENT NO. : 4,945,833

DATED : August 7, 1990

INVENTOR(S) : Kohzoh Arahara, et al.

It is certified that error appears in the above-identified patent and that said Letters Patent is hereby corrected as shown below:

COLUMN 3

Line 67, delete "a".

COLUMN 5

Line 23, change "form," to -- , --.

Line 30, change "NON-Adhesiveness" to -- Non-Adhesiveness --.

UNITED STATES PATENT AND TRADEMARK OFFICE

CERTIFICATE OF CORRECTION

PATENT NO. : 4,945,833

DATED : August 7, 1990

INVENTOR(S) : Kohzoh Arahara, et al.

It is certified that error appears in the above-identified patent and that said Letters Patent is hereby corrected as shown below:

COLUMN 7

Line 39, change "4.5"9." to -- 4.5-9. --.

COLUMN 9

Lines 60-68, change

" 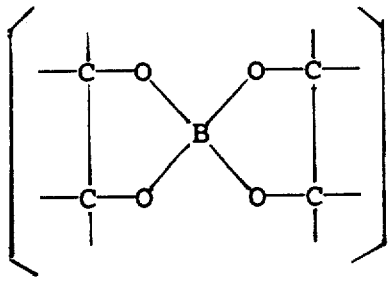 $H^+$ " -- 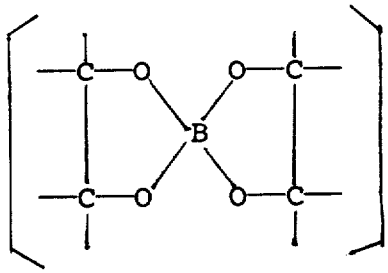 $H^+$ --.

UNITED STATES PATENT AND TRADEMARK OFFICE

CERTIFICATE OF CORRECTION

PATENT NO. : 4,945,833

DATED : August 7, 1990

INVENTOR(S) : Kohzoh Arahara, et al.

It is certified that error appears in the above-identified patent and that said Letters Patent is hereby corrected as shown below:

COLUMN 10

Lines 11-21, please change

"

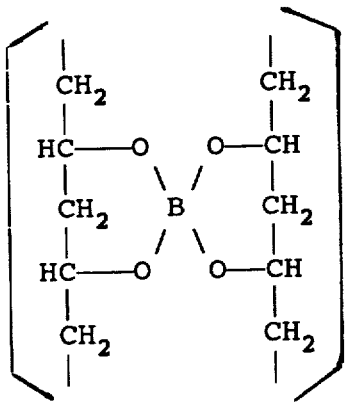

+ 7/2$H_2O$

"

to

--

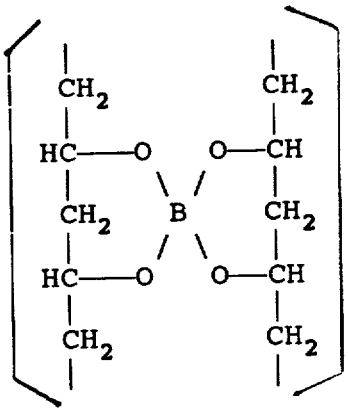

-

+ 7/2$H_2O$

--

UNITED STATES PATENT AND TRADEMARK OFFICE

CERTIFICATE OF CORRECTION

PATENT NO. : 4,945,833

DATED : August 7, 1990

INVENTOR(S) : Kohzoh Arahara, et al.

It is certified that error appears in the above-identified patent and that said Letters Patent is hereby corrected as shown below:

COLUMN 11

Line 30, change "he" to -- the --.

COLUMN 12

Line 20, change "and" to -- or --.

Line 43, change "adjacently" to -- adjacent --.

COLUMN 14

Line 30, change "in" to -- In --.

COLUMN 18

Line 22, delete "to" (third occurrence).

Signed and Sealed this

Thirtieth Day of March, 1993

*Attest:*

STEPHEN G. KUNIN

*Attesting Officer*

*Acting Commissioner of Patents and Trademarks*